US009512581B2

(12) United States Patent
Goddard et al.

(10) Patent No.: US 9,512,581 B2
(45) Date of Patent: Dec. 6, 2016

(54) RAPID DEPLOYMENT BARRIER SYSTEM

(71) Applicant: Caylym Technologies International, LLC, Hanford, CA (US)

(72) Inventors: Richard Goddard, Hanford, CA (US); James Tadlock, Olympia, WA (US); Kyle Goddard, Fresno, CA (US); James Wilson, Springfield, VA (US); Edward Kleiman, Jupiter, FL (US)

(73) Assignee: Caylym Technologies International, LLC, Hanford, CA (US)

( * ) Notice: Subject to any disclaimer, the term of this patent is extended or adjusted under 35 U.S.C. 154(b) by 415 days.

(21) Appl. No.: 14/192,259

(22) Filed: Feb. 27, 2014

(65) Prior Publication Data

US 2015/0240437 A1 Aug. 27, 2015

(51) Int. Cl.
*E02B 3/10* (2006.01)
*E02B 3/12* (2006.01)

(52) U.S. Cl.
CPC ..... *E02B 3/108* (2013.01); *E02B 3/127* (2013.01)

(58) Field of Classification Search
CPC ..... E02B 3/108; E02B 3/127; E02B 3/106; E02B 7/005; E02B 3/04; E02B 15/0885
USPC ..... 405/107, 110, 111, 115
See application file for complete search history.

(56) References Cited

U.S. PATENT DOCUMENTS 73,318 A * 1/1868 Cossins ..... E02B 3/10 405/107
352,544 A * 11/1886 Kernaghan ..... E02B 3/10 405/107
2,306,321 A * 12/1942 Roberts ..... B64D 1/16 102/369
2,515,059 A * 7/1950 Rowbotham ..... E02B 3/102 405/110
2,609,666 A * 9/1952 Mesnager ..... B65D 88/02 405/115
2,784,895 A * 3/1957 Linwood, Jr. ..... B65D 5/28 206/594
3,066,842 A * 12/1962 Croley ..... B65D 5/12 229/120.03
3,191,386 A * 6/1965 Wiegel ..... E02B 3/06 405/115
3,213,628 A * 10/1965 Serota ..... E02B 3/108 220/62.21
3,246,474 A * 4/1966 Masnager ..... E02B 7/005 405/115
3,373,568 A * 3/1968 Hornbostel, Jr. ..... E02B 3/04 405/115

(Continued)

FOREIGN PATENT DOCUMENTS

| | | |
|---|---|---|
| CN | 102304909 | 1/2012 |
| DE | 102006039795 | 4/2007 |
| EP | 1614811 | 1/2006 |

OTHER PUBLICATIONS

International Search Report and Written Opinion for International Application No. PCT/US20151017795; Jun. 2, 2015; 12 pages.

*Primary Examiner* — Benjamin Fiorello
*Assistant Examiner* — Edwin Toledo-Duran
(74) *Attorney, Agent, or Firm* — Stetina Brunda Garred and Brucker

(57) ABSTRACT

A rapid deployment barrier which is specifically configured and adapted to be easily transitionable between a stowed configuration during storage and transport, and a deployed configuration when constructing the barrier. The barrier may be transitioned between the stowed and deployed configuration at the site of the needed barrier, and may be filled with a wide variety of readily available filling material, including the medium for which the barrier may be intended to blockade

19 Claims, 8 Drawing Sheets

(56) References Cited

U.S. PATENT DOCUMENTS 3,401,905 A * 9/1968 Rohrlick ..... B64D 1/02 244/137.3
3,465,530 A * 9/1969 Renfro ..... E02B 3/102 405/110
3,485,302 A * 12/1969 Thorpe ..... A62C 3/0242 169/53
3,603,536 A * 9/1971 Dochow ..... B64D 1/02 244/142
3,655,116 A * 4/1972 Tanner ..... B65D 5/10 229/156
3,710,868 A * 1/1973 Chadwick ..... B64D 1/16 169/53
3,741,462 A * 6/1973 Flint ..... B65D 5/18 206/588
3,834,167 A * 9/1974 Tabor ..... E02B 7/005 405/115
3,853,235 A * 12/1974 Lambert ..... B65B 69/0008 414/412
3,886,751 A * 6/1975 Porraz Jimenez Labora ..... B28B 7/065 383/32
3,904,105 A * 9/1975 Booth ..... B65D 5/12 206/386
4,169,568 A * 10/1979 Drew ..... B64D 17/42 206/524.8
4,194,652 A * 3/1980 Williamson ..... B65D 88/1612 112/418
4,279,540 A * 7/1981 Suga ..... E02B 7/005 405/115
4,352,591 A * 10/1982 Thompson ..... E02B 7/005 210/170.01
4,498,810 A * 2/1985 Muramatsu ..... E02B 7/005 405/115
4,650,368 A * 3/1987 Bayer ..... E02B 3/127 383/102
4,661,014 A * 4/1987 Aubert ..... E02B 3/04 405/111
4,662,783 A * 5/1987 Muramatsu ..... E02B 7/005 405/115
4,664,342 A * 5/1987 Jones ..... B64D 17/60 244/147
4,692,060 A * 9/1987 Jackson, III ..... E02B 3/108 256/13
4,784,520 A * 11/1988 Stevens ..... E01D 19/02 405/107
4,787,774 A * 11/1988 Grove ..... E02B 7/44 405/101
4,807,299 A * 2/1989 Nattrass ..... B65D 88/1681 383/109
4,836,713 A * 6/1989 Muramatsu ..... E02B 7/005 405/115
4,865,273 A * 9/1989 Jones ..... B64D 17/56 244/149
4,909,666 A * 3/1990 Takasaki ..... E02B 7/005 405/107
4,919,306 A * 4/1990 Heaps, Jr. ..... B65D 77/061 222/105
4,921,373 A * 5/1990 Coffey ..... E02B 7/16 256/13
4,981,392 A * 1/1991 Taylor ..... E02B 3/108 383/108
5,012,972 A * 5/1991 Nordstrom ..... B65D 5/4204 229/109
5,059,065 A * 10/1991 Doolaege ..... E02B 7/005 405/107
5,067,851 A * 11/1991 Fujisawa ..... E02B 7/005 405/115
5,173,344 A * 12/1992 Hughes ..... C09K 3/10 405/107
5,176,468 A * 1/1993 Poole ..... E02B 3/06 405/111
5,388,928 A * 2/1995 Kumagai ..... E02B 7/005 405/115
5,470,177 A * 11/1995 Hughes ..... E02B 3/108 405/107
5,618,011 A * 4/1997 Sadeck ..... B64D 17/24 24/573.11
5,677,016 A * 10/1997 Ferraiolo ..... E02D 29/0208 428/116
5,865,564 A * 2/1999 Miller ..... E02B 3/108 405/114
6,015,057 A * 1/2000 Stone ..... B65D 88/1625 220/9.2
6,022,172 A * 2/2000 Siyaj ..... E02B 3/108 405/110
6,059,491 A * 5/2000 Striefel ..... E01F 15/086 256/13.1
6,085,810 A * 7/2000 Castillo ..... B65B 9/15 141/114
6,186,701 B1 * 2/2001 Kempers ..... E02B 3/127 383/105
6,296,420 B1 * 10/2001 Garbiso ..... E02B 3/108 383/69
6,390,154 B1 * 5/2002 Hall ..... E02B 3/108 141/314
6,470,805 B1 * 10/2002 Woodall ..... A62C 3/025 102/370
6,481,928 B1 * 11/2002 Doolaege ..... E01D 15/20 138/98
6,672,799 B2 * 1/2004 Earl ..... E02B 3/108 404/6
6,672,800 B2 * 1/2004 Frank ..... E02B 3/108 405/114
6,715,960 B2 * 4/2004 Metz ..... E02B 3/108 405/111
7,029,200 B1 * 4/2006 Cravens ..... E02B 3/04 405/111
7,090,029 B2 * 8/2006 Cleary ..... A62C 3/025 169/36
7,648,754 B2 * 1/2010 Halahmi ..... E02D 17/20 405/111
8,480,034 B2 * 7/2013 Goddard ..... 169/53
8,540,456 B2 * 9/2013 Marshall ..... B65D 90/24 405/107
8,636,445 B1 * 1/2014 Williams ..... B65D 90/24 220/9.4
2002/0110424 A1 * 8/2002 Page ..... E02B 3/108 405/115
2003/0161688 A1 * 8/2003 Frank ..... E02B 3/108 405/115
2003/0215165 A1 * 11/2003 Hogan ..... B65D 33/1691 383/206
2004/0156680 A1 * 8/2004 Gibbs ..... E02B 3/06 405/15
2004/0234340 A1 * 11/2004 Cho ..... E02B 3/106 405/107
2005/0260038 A1 * 11/2005 Sousa Costa ..... E02B 3/127 405/115
2006/0099033 A1 * 5/2006 Boraggina ..... E02B 3/108 405/107
2006/0275084 A1 * 12/2006 Harbeck ..... E02B 3/108 405/116
2007/0090174 A1 * 4/2007 Goddard ..... A62C 3/0235 229/100
2010/0018724 A1 * 1/2010 Cleary ..... B64D 1/12 169/46
2013/0107506 A1 * 5/2013 Mustafa ..... B25B 5/101 362/183
2013/0292142 A1 * 11/2013 Goddard ..... A62C 3/0235 169/46

* cited by examiner

RAPID DEPLOYMENT BARRIER SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a barrier system, and more particularly to a barrier system specifically configured and adapted to be easily transported and quickly assembled at a remote location when needed.

2. Related Art

It is readily understood that weather conditions are unpredictable. Along these lines, the sprawl of developed land has led to a general increase in terrains that are subject to undesirable and unpredictable weather conditions, such as flooding, mudslides and erosion. For instance, high-yield crop lands, residential and commercial structures, roadways, railways, and other forms of commercial development located adjacent bodies of water such as rivers, lakes, oceans, etc., are susceptible to flooding, which can potentially cause massive material damage and also create potentially life-threatening situations.

Land developers have identified particular areas which are more prone to flooding, and in some instances, have erected or constructed permanent earth dikes or levees. Indeed, there are an estimated 14,000 miles of levees owned and maintained by the U.S. Army Corps of Engineers and an estimated 85,000 miles of privately-owned and operated levees. However, in certain circumstances, such dikes or levees may fail for a variety of reasons, some of which are not weather related. Along these lines, most dikes and levees are more than 50 years old, and many were built in agricultural areas, which are not located in urban areas. Breaches in levees can cause severe flooding, leading to catastrophic disaster. When levees are breached, time tends to be a critical factor in evacuations, emergency response, repairs and protecting nearby infrastructures. A rapid repair system for providing temporary, quick fixes to levee breaches in hours rather than days can significantly assist in reducing the loss of life and property damage.

In the event of flooding, mudslides, erosion, etc., whether caused by unexpected weather conditions, or a failure of a dike or levee, it is well known to utilize a plurality of sandbags to construct a temporary barrier. Conventional sandbags generally include a sack formed of burlap or polypropylene, which is then filed with sand or soil. The sandbags may be stacked or placed at the site of the needed barrier in response to changing weather conditions, or in anticipation of certain climatic events.

Although sandbags provide certain benefits associated with constructing a temporary barrier, the use of sandbags also suffers from several deficiencies. On particular deficiency associated with sandbags is that the sandbags require sand or soil to be filled. In this respect, if one does not have access to sand or soil where the sandbags are to be filled, it may be difficult or impossible to use sandbags for constructing a barrier. Another problem readily associated with sandbags is that they typically require that the sandbag is filled prior to being stacked as part of the barrier. As such, considerable effort may be required to lift and move the filled sandbag for purposes of stacking the sandbag within the barrier.

Accordingly, there is a need in the art for an easily deployable barrier system that is not solely dependent on readily available soil or sand. Various aspects of the present invention are directed toward addressing these needs, as will be discussed in more detail below.

BRIEF SUMMARY

Various aspects of the present invention are directed toward a rapid deployment barrier which is specifically configured and adapted to be easily transitionable between a stowed configuration and a deployed configuration. The barrier may be transitioned between the stowed and deployed configuration at the site of the needed barrier, and may be filled with a wide variety of readily available filling materials, including the medium for which the barrier may be intended to blockade (such as flood waters). The barrier may also be set in place prior to being filled with the filling material, thereby making it easier to lift and place the barrier components when assembling the barrier. The barrier is also configured to provide an enhanced strength to weight ratio in set up and enhanced quickness of achieving barrier height in a very short time, compared to conventional sand bags.

According to one embodiment, there is provided a kit for a rapid deployment barrier. The kit includes a pair of barrier units configured to be selectively deployable adjacent to each other to collectively define a barrier. Each barrier unit includes a peripheral wall having opposed internal and external surface, wherein the internal surface defines an inner opening. The peripheral wall is transitional between a collapsed configuration and an expanded configuration, wherein opposed portions of the peripheral wall move away from each other as the peripheral wall transitions from the folded configuration toward the expanded configuration. A base panel is positionable in the inner opening in generally orthogonal relation to the peripheral wall when the peripheral wall is in the expanded configuration. The base panel is configured to maintain the peripheral wall in the expanded configuration when positioned in the inner opening in generally orthogonal relation to the peripheral wall. Each barrier unit further includes an end cap having opposed internal and external surfaces. The end cap is engageable with the peripheral wall and is configured to cover the inner opening when the peripheral wall is in the expanded configuration. A first water resistant liner having a closed end portion is positionable over the external surfaces of the peripheral wall and the end cap when engaged with the peripheral wall. A second water resistant liner having a closed end portion is positionable over internal surfaces of the peripheral wall and the end cap when engaged with the peripheral wall.

Each barrier unit is selectively transitional between a stowed configuration and a deployed configuration. In this stowed configuration, the peripheral wall is in the collapsed configuration. In the deployed configuration, the peripheral wall is in the expanded configuration, the base panel is positioned in generally orthogonal relation to the peripheral wall, the end cap is positioned over the inner opening, and the first and second water resistant liners are positioned over external and internal surfaces of the peripheral wall, respectively.

A strap is disposable and tightenable about the pair of barrier units when the pair of barrier units are in the deployed configuration to apply a compressive force on the pair of barrier units to urge the pair of barrier units toward each other.

The peripheral wall may include a plurality of panels pivotable relative to each other and interconnected to each other about the inner opening. The peripheral wall may include four panels, wherein adjacent ones of the panels are generally orthogonal to each other when the peripheral wall is in the expanded configuration, and adjacent ones of the panels are in non-orthogonal relation to each other when the peripheral wall is in the collapsed configuration. The peripheral wall may be formed from a cardboard material, corrugated material or fiber based material.

Each barrier unit may define an opening sized to receive a filling material.

The base panel may include two panels foldable relative to each other.

The end cap may include a pair of separate end cap members which collectively define the end cap.

The first and second liners may at least partially overlap along the external surface of the peripheral wall.

The kit may further include an inwardly biased looped band expandable around the peripheral wall and configured to impart a compressive force on at least one of the first and second water resistant liners.

In addition to the foregoing, there is also provided a method of constructing a rapid deployment barrier. The method includes providing a pair of barrier units, wherein each barrier unit is selectively transitional between a stowed configuration and a deployed configuration. Each barrier unit includes a base panel, and a peripheral wall having opposed internal and external surfaces. The internal surface defines an inner opening. The peripheral wall is selectively transitional between a collapsed configuration and an expanded configuration. The base panel is disposable within the inner opening in generally orthogonal relation to the peripheral wall when the peripheral wall is in the expanded configuration. An end cap is engageable with the peripheral wall and is disposable over the inner opening adjacent the base panel when the peripheral wall is in the expanded configuration. Each barrier unit further includes first and second waterproof liners, and a strap. The method further includes transitioning a first one of the pair of barrier units from the stowed configuration to the deployed configuration. The transitioning step includes moving the peripheral wall from the collapsed configuration into the expanded configuration and inserting the base panel within the inner opening. The base panel is generally orthogonal to the peripheral wall, with the base panel and peripheral wall collectively defining the barrier unit internal surface. The method further includes placing the end cap over the inner opening adjacent the base panel, wherein the end cap and peripheral wall collectively define the barrier unit external surface. The first and second waterproof liners are placed along portions of the base panel, peripheral wall, and end wall such that the peripheral wall, base panel and end wall are substantially enclosed by the first and second waterproof liners, collectively. The method includes repeating the transitioning step for the second one of the pair of barrier units, and placing the strap around the pair of barrier units when the pair of barrier units are both in their respective deployed configurations.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
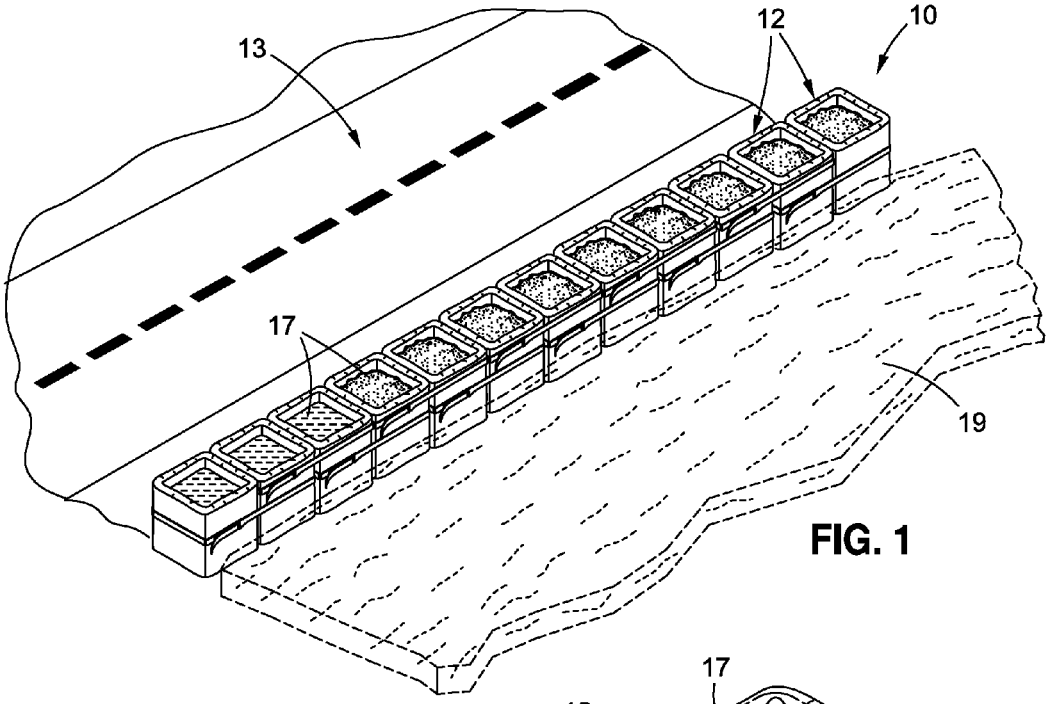
FIG. 1 is an upper perspective view of a rapid deployment barrier constructed in accordance with an embodiment of the present invention.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the drawings, wherein the showings are for purposes of illustrating a preferred embodiment of the present invention only and are not for purposes of limiting the same, there is depicted a rapid deployment barrier 10 comprised of a plurality of interconnected barrier units 12. As will be described in more detail below, the barrier units 12 are specifically configured and adapted to be easily deployed and quickly assembled on site for erecting the barrier 10. According to one aspect of the invention, the barrier units 12 can assume a compact, stowed configuration to facilitate storage thereof and subsequent transport of the barrier units 12 to the barrier site. Once the barrier units 12 arrive at the barrier site, the barrier units 12 can be easily transitioned from their stowed configuration to a deployed configuration, wherein they may be placed in adjacent relation to one another to form the barrier 10. The barrier units 12 are additionally configured to allow a local filling material, including solid materials, such as sand, dirt, rocks, etc., to be used for filling the barrier units 12, in addition to liquid materials, such as water, mud, etc., for stabilizing the barrier 10. In this respect, the barrier units 12 are not solely dependent upon sand or soil, as are conventional sandbags. Furthermore, the barrier 10 is configured for quick and simple set-up and fill with significantly lower labor demand than conventional sandbags.

Figure 2:
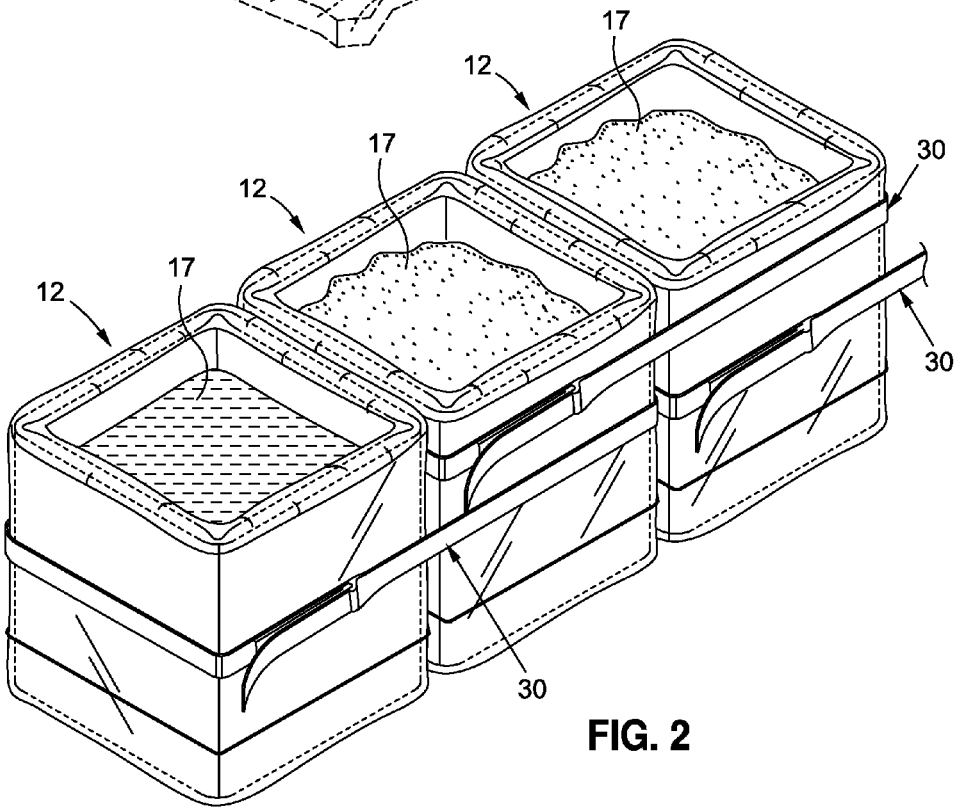
FIG. 2 is an upper perspective view of a plurality of barrier units used for constructing the barrier.

Referring now specifically to FIGS. 1 and 2, there is shown a barrier 10 constructed along a roadway 13 to prevent flood waters 19 from flowing over the roadway 13. As can be seen, the individual barrier units 12 are interconnected to each other via straps 30, and include a filling material 17 disposed within the barrier units 12 for weighing down the barrier units 12. Some of the barrier units 12 are filled with sand, while other barrier units 12 are filled with liquid/water. In this respect, it is readily contemplated that the barrier units 12 may be filled with the medium/material for which the barrier 10 is intended to block. In the case of FIG. 1, the barrier 10 is intended to block the flood waters 19 from the roadway 13, and thus, the flood waters 19 may be used as a filling material. As such, the deployment and structural integrity of the barrier 10 is adaptable depending on the conditions and location of the barrier 10.

Figure 3:
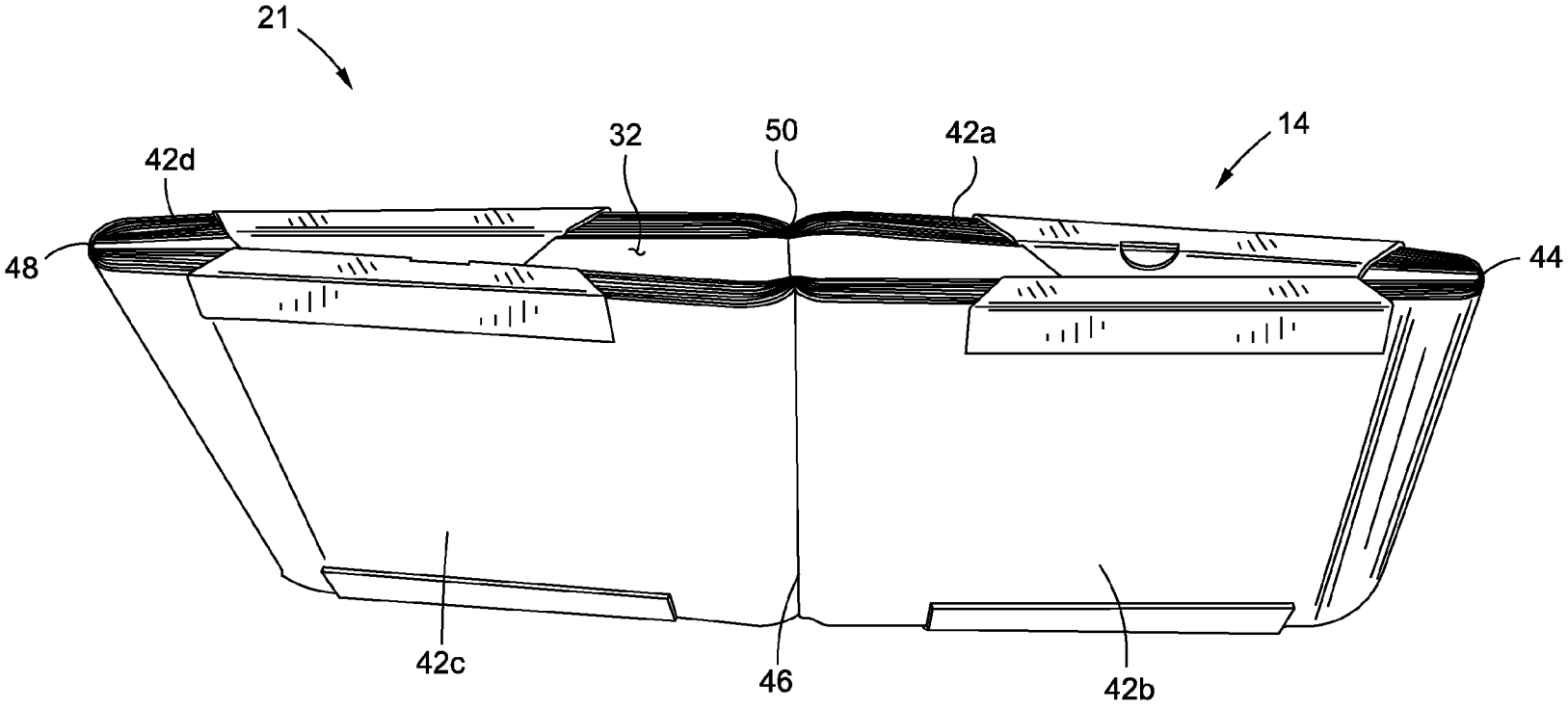
FIG. 3 is an upper perspective view of a barrier unit peripheral wall in a collapsed configuration.
Figure 4:
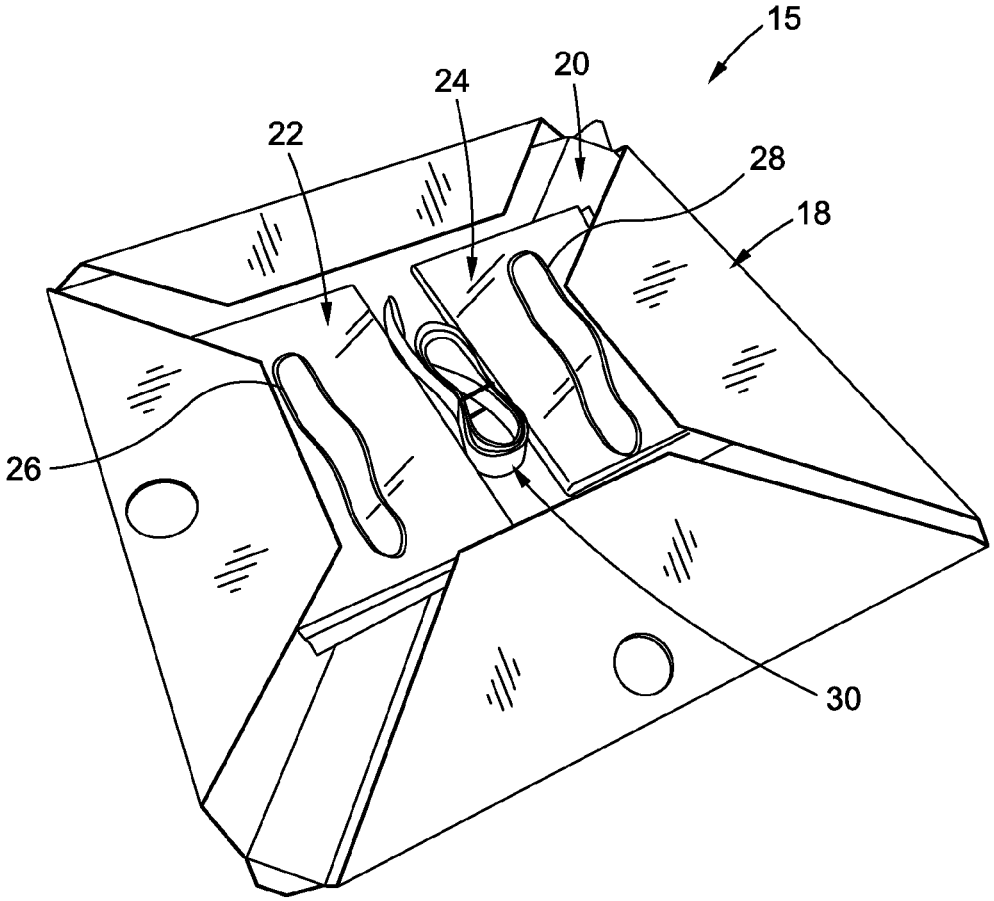
FIG. 4 is an upper perspective view of an end cap, base panel, water resistant liners, straps and bands used in constructing the barrier unit.

Referring now specifically to FIGS. 3 and 4, the components used for constructing the barrier unit 12 are shown in their stowed configuration. In particular, FIG. 3 shows an outer package assembly 21 including a peripheral wall 14 of a single barrier unit 12, with the peripheral wall 14 being in a collapsed configuration. FIG. 4 shows an inner package assembly 15 including end cap 18, a base panel 20, a first water resistant liner 22, a second water resistant liner 24, a first securement band 26, a second securement band 28, and a strap 30. The peripheral wall 14, base panel 20 and end cap 18 may be formed from a cardboard material, corrugated material, fiber based material, or other materials known in the art. As shown in FIGS. 3 and 4, the peripheral wall 14 and various components depicted in FIG. 4 are arranged in a flattened configuration to facilitate packaging and transport of the barrier unit 12. Along these lines, when the peripheral wall 14 is in a collapsed, flattened configuration, the peripheral wall 14 may define a slot 32 (see FIG. 3) within which the end cap 18 and the various components residing thereon (as shown in FIG. 4) may be stowed.

Figure 5:
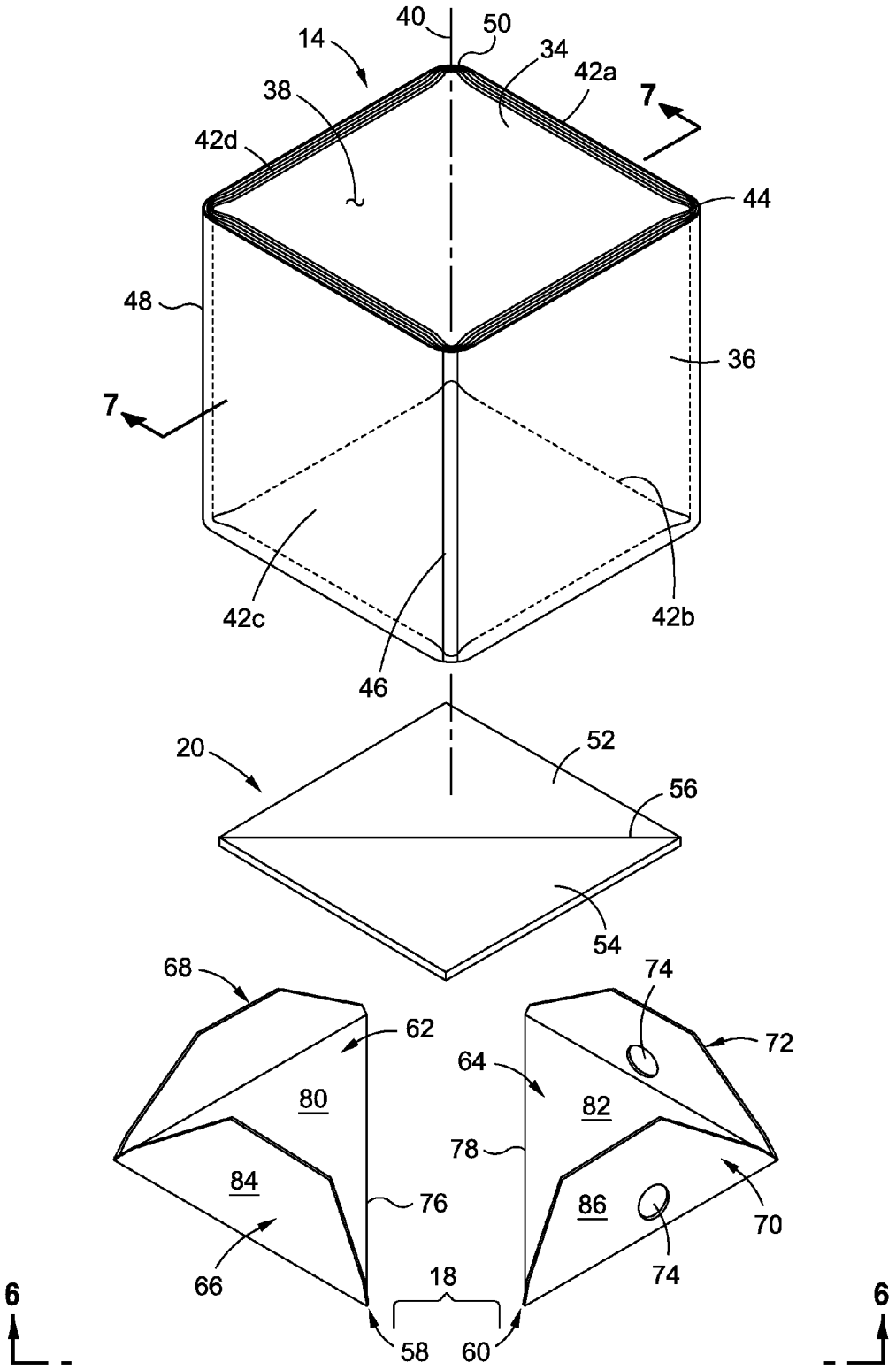
FIG. 5 is an upper perspective exploded view of the peripheral wall, base panel and end cap.

In order to transition the barrier unit 12 from the collapsed configuration (as shown in FIG. 3) to the expanded configuration (as shown in FIG. 5), the inner package assembly 15 is removed from the slot 32.

Referring now to FIG. 5, the peripheral wall 14 is shown in the expanded configuration, which is contrasted with the collapsed figuration shown in FIG. 3. The exemplary peripheral wall 14 includes an internal surface 34, and an opposing external surface 36, with the internal surface 34 defining an inner opening 38. The expanded peripheral wall 14 is disposed about a central axis 40, with the inner opening 38 extending along the central axis 40.

In the exemplary embodiment, the peripheral wall 14 assumes a generally quadrangular, tubular configuration when the peripheral wall 14 is expanded. Along these lines, the peripheral wall 14 includes four panels 42*a-d* which are pivotable and foldable relative to each other and interconnected to each other about the inner opening 38. In particular, the peripheral wall 14 includes a corner region 44 positioned between panels 42*a* and 42*b*, corner region 46 positioned between panels 42*b* and 42*c*, corner region 48 positioned between panels 42*c* and 42*d*, and corner region 50 positioned between panels 42*d* and 42*a*. When the peripheral wall 14 is in the collapsed configuration, each panel is in generally coplanar alignment with an adjacent panel and in generally opposed relation to a separate adjacent panel. For instance, in the configuration shown in FIG. 3, the panels 42*a* and 42*d* are in generally coplanar alignment with each other, and panels 42*b* and 42*c* are also in generally coplanar alignment with each other. As such, panels 42*a* and 42*b* are disposed in generally opposed relation to each other, with the corner region 44 defining a relatively small angle. Likewise, panels 42*c* and 42*d* are also disposed in generally opposed relation to each other with corner region 48 defining a relatively small angle.

As the peripheral wall 14 transitions from the collapsed configuration to the expanded configuration, one set of opposed corner regions are moved away from each other, while another opposed set of corner regions move toward each other. In the exemplary embodiment, the opposed corner regions 46, 50 are moved away from each other, while opposed corner regions 44, 48 move toward each other until adjacent ones of the panels 42*a-d* are positioned in generally perpendicular relation to each other. In particular, panel 42*a* is generally perpendicular to panel 42*b*, with corner region 44 defining a generally right angle, panel 42*b* is generally perpendicular to panel 42*c* with corner region 46 defining a generally right angle, panel 42*c* is generally perpendicular to panel 42*d* with corner region 48 defining a generally right angle, and panel 42*d* is generally perpendicular to panel 42*a* with corner region 50 defining a generally right angle.

The base panel 20 depicted in FIG. 5 is formed from a pair of interconnected and foldable base panel segments 52, 54 which are foldable relative to each other along fold line 56. The base panel segments 52, 54 may be folded in overlapping arrangement when the barrier unit 12 is in the stowed configuration. The base panel segments 52, 54 may be unfolded to assume a generally coplanar configuration which is generally complimentary in shape to the inner opening 38 of the peripheral wall 14, as shown in FIG. 5.

The end cap 18 includes a pair of separate end cap members 58, 60. Each end cap member includes an end panel 62, 64 and a pair of end flanges, 66, 68, 70, 72. The end flanges 66-72 are foldable relative to the respective end panel 62, 64 to transition the end cap members 58, 60 between their stowed and deployed configurations. In the deployed configuration, the end flanges 66-72 are generally perpendicular to the respective end panel 62, 64. As shown in FIG. 5, one of more of the end flanges 66-72 may include an aperture 74 formed therein. Each end cap member 58, 60 additionally defines an internal surface 80, 82 and an opposing external surface 84, 86.

Each end cap member 58, 60 includes an abutment edge 76, 78 which are placed next to each other to assemble the end cap 18. When assembled, the end cap 18 defines a shape that is complimentary to the expanded peripheral wall 14.

Figure 6:
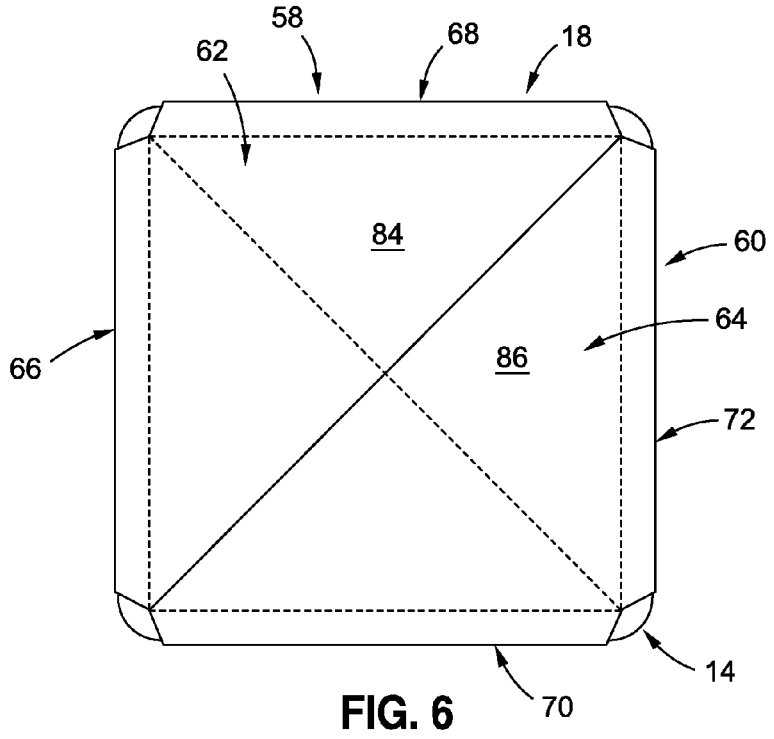
FIG. 6 is a top view of the end cap placed on the peripheral wall over the base panel.
Figure 7:
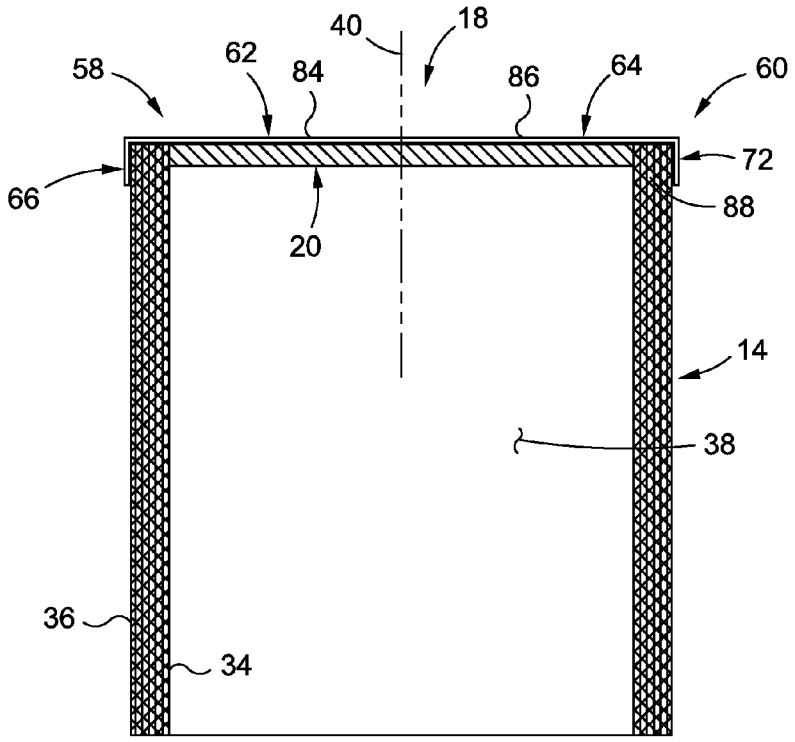
FIG. 7 is a side sectional view of the assembly depicted in FIG. 6.

Referring now to FIGS. 6 and 7, with the peripheral wall 14 in the expanded configuration, the base panel 20 is placed within the peripheral wall 14 adjacent a first end portion 88 thereof and in generally orthogonal relation to the peripheral wall 14. The inserted base panel 20 assists in maintaining the peripheral wall 14 in the expanded configuration by engaging with the internal surface 34 of the peripheral wall 14. The inserted base panel 20 also effectively encloses one end of the inner opening 38 by extending across the inner opening 38 in generally perpendicular alignment to the central axis 40.

Although the exemplary embodiment shows a base panel 20 that is separate from the peripheral wall 14, it is understood that other embodiments may include a base panel 20 that is interconnected to the peripheral wall 14. For instance, the base panel 20 may be pivotally coupled to one of the peripheral wall panels and may pivot between a first position, wherein the base panel 20 does not restrict the peripheral wall 20 from transitioning between its collapsed and expanded configurations, and a second position, wherein the base panel 20 assists in maintaining the peripheral wall 14 in its expanded configuration.

The end cap 18 is placed over the first end portion 88 of the peripheral wall 14, adjacent the base panel 20. The end panels 62, 64 of the respective end cap members 58, 60 extend across the inner opening 38, while the end flanges 66-72 extend along a portion of the external surface 36 of the peripheral wall 14.

Figure 8:
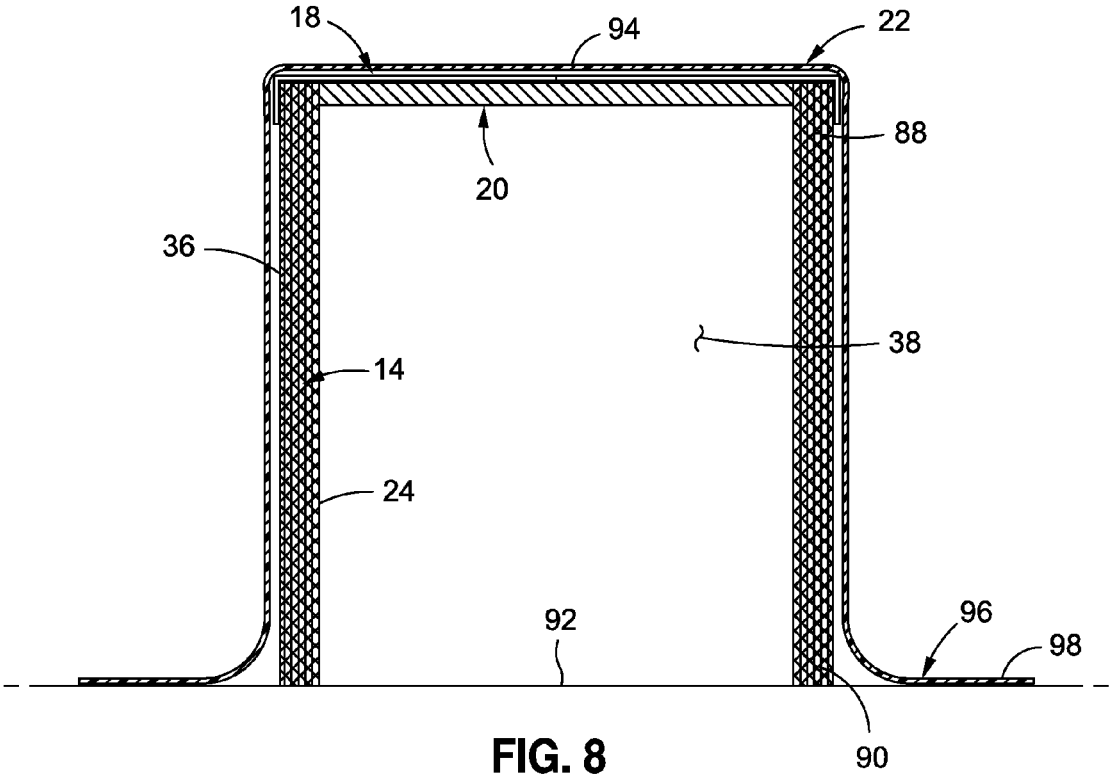
FIG. 8 is a side sectional view of a first water resistant liner draped over the assembly depicted in FIG. 7.
Figure 9:
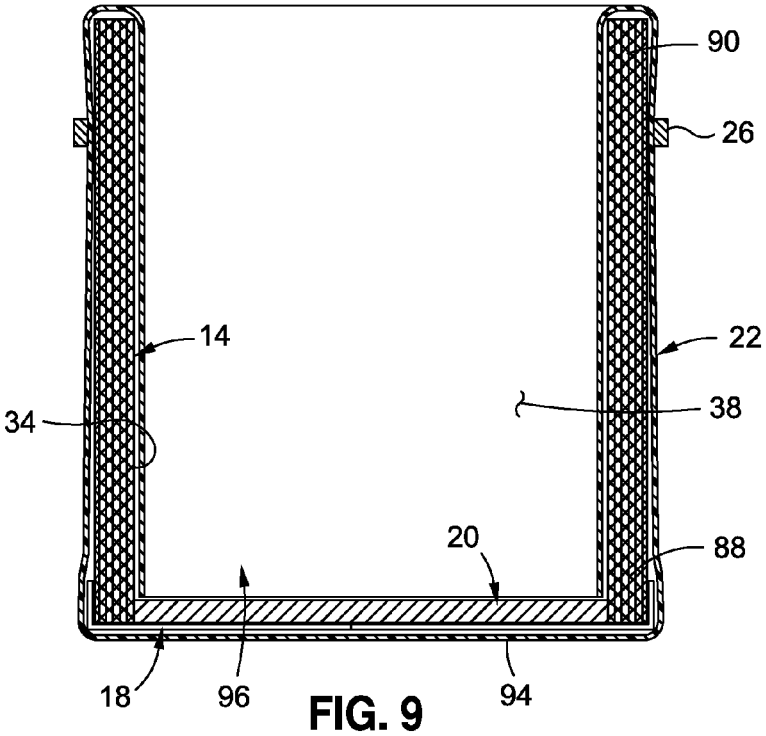
FIG. 9 is a side sectional view of the assembly depicted in FIG. 8 rotated 180 degrees, with a free end of the first water resistant liner folded around an end of the peripheral wall.

Referring now to FIG. 8, the first water resistant liner 22 is placed over the end cap 18 and the peripheral wall 14. According to one embodiment, the first water resistant liner 22 is placed over the end cap 18 and peripheral wall 14 by standing the peripheral wall 14 on end with a second end portion 90 of the peripheral wall 14 being placed adjacent a support surface 92 with the first end portion 88 extending away from the support surface 92. The first water resistant liner 22 includes a closed end portion 94 that is placed over the end cap 18. The first water resistant liner 22 is sized and configured to extend over the end cap 18, and along the external surface 36 of the peripheral wall 14 and includes an open end portion 96 having a segment 98 which lies on the support surface 92.

While maintaining the first water resistant liner 22 in place, the peripheral wall 14 is rotated 180° such that the first end portion 88 is now supported by the support surface 92 and the second end portion 90 extends away from the support surface 92. Segment 98 is wrapped around the second end portion 90 to extend into the inner opening 38 along a portion of the internal surface 34. The first securement band 26 may be placed around the first water resistant liner 22, preferably adjacent the second end portion 90 to maintain the first water resistant liner 22 in place. The first securement band 26 may be a heavy duty elastic or rubber band. In this arrangement, the first water resistant liner 22 extends along or covers the external surfaces of the peripheral wall 14 and end cap 18.

Figure 10:
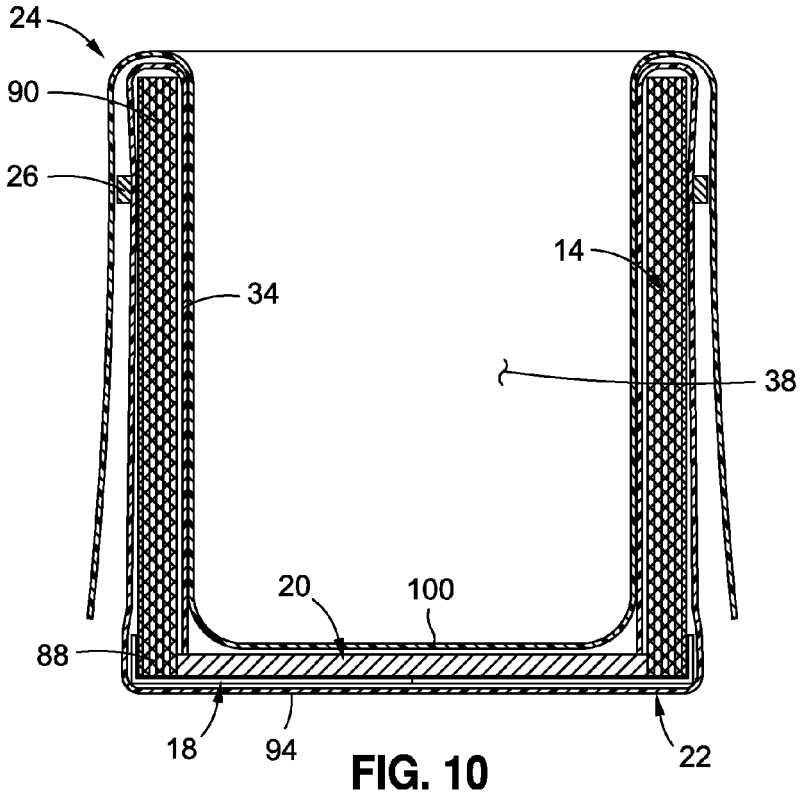
FIG. 10 is a side sectional view of a second water resistant liner placed within the assembly depicted in FIG. 9.
Figure 11:
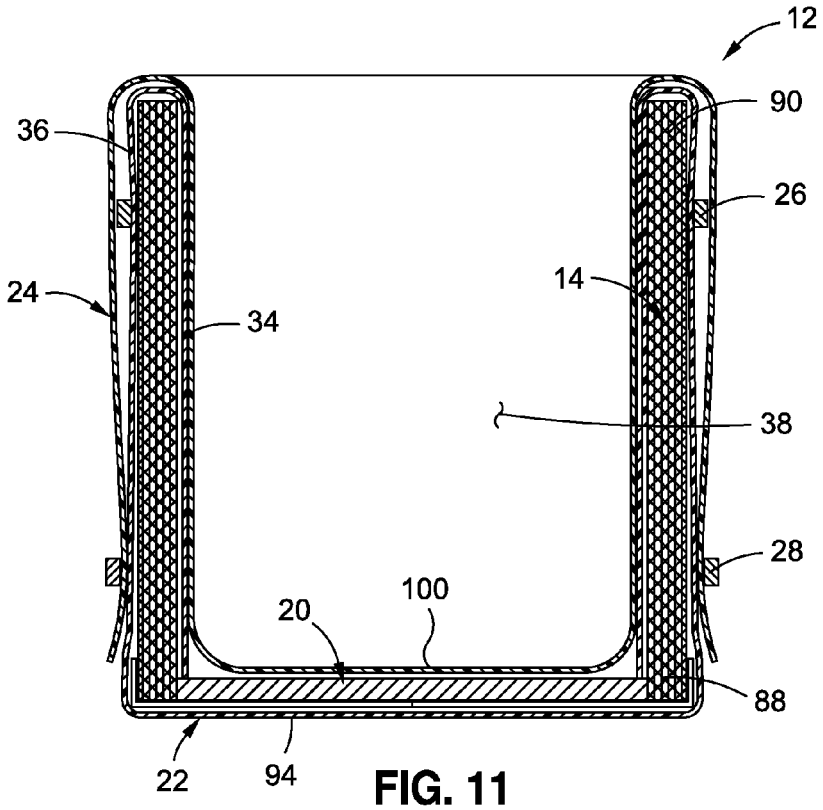
FIG. 11 is a side sectional view of the assembly depicted in FIG. 10 with the first and second water resistant liners secured to the peripheral wall.

Referring now to FIGS. 10 and 11, the second water resistant liner 24 is used to line the interior surfaces. In particular, the second water resistant liner 24 includes a closed end portion 100 that is inserted into the inner opening 38 and placed along the internal surface of the base panel 20. The second water resistant liner 24 extends along the base panel 20 and the internal surface 34 of the peripheral wall 14. The water resistant liner 24 continues around a second end portion 90 of the peripheral wall 14 and along or over the external surface 36. The second water resistant liner 24 may extend over the first securement band 26 or alternatively, the second water resistant liner 24 may be routed through the band 26. With the second water resistant liner 24 in place, the second securement band 28 is used to secure the free end portion thereof. The second securement band 28, like the first securement band 26, may include a heavy duty elastic or rubber band.

When the first and second water resistant liners 22, 24 are secured in the configuration shown in FIG. 11, the liners 22, 24 collectively surround a peripheral wall 14, the base panel 20, and the end cap 18 to provide a water resistant layer around the peripheral wall 14, base panel 20 and end cap 18.

Figure 12:
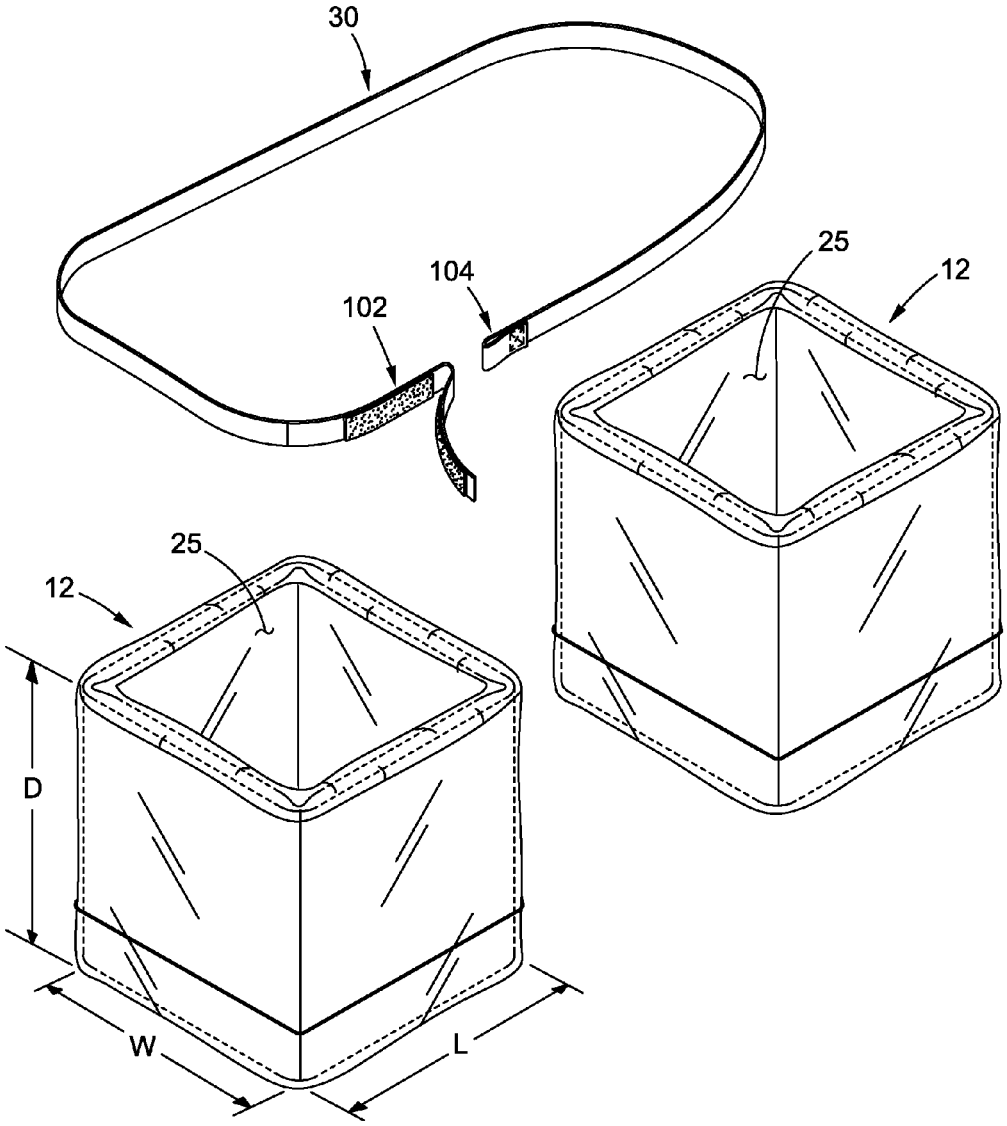
FIG. 12 is an exploded upper perspective view of a pair of barrier units and a securement strap.

Referring now specifically to FIG. 12, each barrier unit 12 defines a depth "D," a width "W," and a length "L." According to one embodiment the width W is approximately equal to 40 inches, the length is approximately equal to 48 inches, and the depth D may be 40 inches, 36 inches or 20 inches. It is contemplated that the size and shape of the barrier units 12 may vary from one embodiment to the next. In this respect, the dimensions noted above in relation to the embodiment shown in FIG. 12 are exemplary in nature only, as it is understood that the depth, width and length may be varied without departing from the spirit and scope of the present invention.

With the barrier units 12 assembled so as to define an opening 25 within which a filling material may be inserted. In one embodiment, the opening 25 defines a volume that is approximately equal to 137-275 gallons. However, before being filled, the barrier units 12 are placed next to each other and the strap 30 is placed around the barrier units 12 to maintain the barrier units 12 in close proximity to each other. The strap 30 includes a first end portion 102 and an opposing end portion 104 which are sized and configured to be adjustably engageable there between. In this respect, the first end portion 102 may include hook and loop fastening material, buttons, straps for securing the strap 30 in a closed loop configuration around the pair of barrier units 12. The strap 30 is also configured to be cinched around the barrier units 12 to increase the tension in the strap for urging the barrier units 12 toward each other.

Referring back to FIGS. 1 and 2, adjacent pairs of barrier units 12 may be interconnected through a plurality of straps 30 to define a series or array of barrier units 12 which collectively define the barrier 10. The barrier units 12 may be filled with a filling material, which may include sand, rock, gravel, cement, or any filling medium that is readily available. For instance, if the barrier 10 is being deployed for flood control purposes, the barrier units 12 may actually be filled with the flood water which the barrier 10 is intended to block. According to one embodiment, the barrier units 12 are high strength units, wherein each barrier unit 12 is capable of holding approximately 1,100-2,200 lbs. of weight.

When the barrier 10 is no longer needed, breakdown of the barrier 10 may be achieved quickly and easily. In this respect, the straps 30 used to connect adjacent barrier units 12 may be removed, and the barrier units 12 may be emptied of the filling material. Once the filling material is removed, the barrier unit 12 may be easily collapsed and removed.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A kit for a rapid deployment barrier, the kit comprising:

a pair of barrier units configured to be selectively deployable adjacent to each other to collectively define a barrier, each barrier unit comprising:

a peripheral wall having opposed internal and external surface, the internal surface defining an inner opening, the peripheral wall being transitional between a collapsed configuration and an expanded configuration, opposed portions of the peripheral wall moving away from each other as the peripheral wall transitions from the folded configuration toward the expanded configuration;

a base panel positionable in the inner opening in generally orthogonal relation to the peripheral wall when the peripheral wall is in the expanded configuration, the base panel being configured to maintain the peripheral wall in the expanded configuration when positioned in the inner opening in generally orthogonal relation to the peripheral wall;

an end cap having opposed internal and external surfaces and being engageable with the peripheral wall and configured to cover the inner opening when the peripheral wall is in the expanded configuration;

a first water resistant liner having a closed end portion positionable over the external surfaces of the peripheral wall and the end cap when engaged with the peripheral wall; and a second water resistant liner having a closed end portion positionable over internal surfaces of the peripheral wall and the end cap when engaged with the peripheral wall;

each barrier unit being selectively transitional between:

a stowed configuration wherein the peripheral wall is in the collapsed configuration; and a deployed configuration, wherein the peripheral wall is in the expanded configuration, the base panel is positioned in generally orthogonal relation to the peripheral wall, the end cap is positioned over the inner opening, and the first and second water resistant liners are positioned over external and internal surfaces of the peripheral wall, respectively; and a strap disposable and tightenable about the pair of barrier units when the pair of barrier units are in the deployed configuration to apply a compressive force on the pair of barrier units to urge the pair of barrier units toward each other.

2. The kit recited in claim 1, wherein the peripheral wall includes a plurality of panels pivotable relative to each other and interconnected to each other about the inner opening.

3. The kit recited in claim 2, wherein the peripheral wall includes four panels, adjacent ones of the panels being generally orthogonal to each other when the peripheral wall is in the expanded configuration, adjacent ones of the panels being in non-orthogonal relation to each other when the peripheral wall is in the collapsed configuration.

4. The kit recited in claim 1, wherein the peripheral wall is formed from a one of a corrugate material and a fiber based material.

5. The kit recited in claim 1, wherein each barrier unit defines an opening sized to receive a filling material.

6. The kit recited in claim 1, wherein the base panel includes two panels foldable relative to each other.

7. The kit recited in claim 1, wherein the end cap includes a pair of separate end cap members which collectively define the end cap.

8. The kit recited in claim 1, wherein the first and second liners at least partially overlap along the external surface of the peripheral wall.

9. The kit recited in claim 1, further comprising an inwardly biased looped band expandable around the peripheral wall and configured to impart a compressive force on at least one of the first and second water resistant liners.

10. A method of constructing a rapid deployment barrier, the method comprising the steps of:

providing a pair of barrier units, each barrier unit being selectively transitional between a stowed configuration and a deployed configuration, each barrier unit comprising:

a base panel;

a peripheral wall having opposed internal and external surfaces, the internal surface defining an inner opening, the peripheral wall being selectively transitional between a collapsed configuration and an expanded configuration, the base panel being disposable within the inner opening in generally orthogonal relation to the peripheral wall when the peripheral wall is in the expanded configuration;

an end cap engageable with the peripheral wall and disposable over the inner opening adjacent the base panel when the peripheral wall is in the expanded configuration;

first and second waterproof liners;

a strap;

transitioning a first one of the pair of barrier units from the stowed configuration to the deployed configuration, the transitioning step including:

moving the peripheral wall from the collapsed configuration into the expanded configuration;

inserting the base panel within the inner opening, the base panel being generally orthogonal to the peripheral wall, the base panel and peripheral wall collectively defining the barrier unit internal surface;

placing the end cap over the inner opening adjacent the base panel, the end cap and peripheral wall collectively defining the barrier unit external surface; and placing the first and second waterproof liners along portions of the base panel, peripheral wall, and end wall such that the peripheral wall, base panel and end wall are substantially enclosed by the first and second waterproof liners, collectively;

repeating the transitioning step for the second one of the pair of barrier units;

placing the strap around the pair of barrier units when the pair of barrier units are both in their respective deployed configurations.

11. The method recited in claim 10, wherein the transitioning step further includes:

standing the peripheral wall on a first end thereof in a first orientation, the end cap being placed over the peripheral wall and the first waterproof liner being placed over the barrier unit while the peripheral wall is in the first orientation; and rotating the peripheral wall 180 degrees and standing the peripheral wall on an opposed second end thereof in a second orientation, the second waterproof liner being placed over the barrier unit while the peripheral wall is in the second orientation.

12. The method recited in claim 10, wherein each peripheral wall includes a plurality of interconnecting panels pivotable relative to each other, the step of moving the peripheral wall from the collapsed configuration to the expanded configuration includes pivoting the panels until the peripheral wall is in the expanded configuration.

13. The method recited in claim 10, wherein the first waterproof liner includes a first closed end portion and an opposed first open end portion, the step of placing the first waterproof liner includes placing the first closed end portion over the end wall and the first open end portion around a first end of the peripheral wall opposite the end wall.

14. The method recited in claim 13, wherein the second waterproof liner includes a second closed end portion and an opposing second open end portion, the step of placing the second waterproof liner includes placing the second closed end portion within the inner opening along the base panel and the first open end portion around the first end of the peripheral wall.

15. The method recited in claim 14, wherein the step of placing the first and second waterproof liners includes placing the first and second waterproof liners to create an overlap therebetween along an external surface of the peripheral wall.

16. The method recited in claim 10, further comprising the step of cinching the strap around the pair of barrier units to urge the pair of barrier units toward each other.

17. A kit for a rapid deployment barrier, the kit comprising:

a pair of barrier units configured to be selectively deployable adjacent to each other to collectively define a barrier, each barrier unit comprising:

a collapsible support structure having a closed end portion, an opposing open end portion, an internal surface and an opposing external surface;

an end cap having opposed internal and external surfaces and being engageable with the collapsible support structure and configured to cover the closed end portion when engaged therewith;

a first water resistant liner having a first closed end portion positionable along the external surface of the collapsible support structure and around the closed end portion of the collapsible support structure; and a second water resistant liner having a second closed end portion positionable within the collapsible support structure and positionable along the external surface of the collapsible support structure;

a strap disposable and tightenable about the pair of barrier units when the pair of barrier units are deployed and positioned adjacent each other, the strap being configured to apply a compressive force on the pair of barrier units to urge the pair of barrier units toward each other;

wherein the collapsible support structure includes:

a base panel; and a peripheral wall having opposed internal and external surfaces, the internal surface defining an inner opening, the peripheral wall being selectively transitional between a collapsed configuration and an expanded configuration;

the base panel being disposable within the inner opening in generally orthogonal relation to the peripheral wall when the peripheral wall is in the expanded configuration.

18. The kit recited in claim 17, wherein the first and second liners at least partially overlap along the external surface of the collapsible support structure.

19. The kit recited in claim 17, further comprising an inwardly biased looped band expandable around the collapsible support structure and configured to impart a compressive force on at least one of the first and second water resistant liners.

* * * * *